US008213663B2

(12) United States Patent
Koo

(10) Patent No.: US 8,213,663 B2
(45) Date of Patent: Jul. 3, 2012

(54) EARPHONE VIA DRUMHEAD

(76) Inventor: Youn Young Koo, Seoul (KR)

( * ) Notice: Subject to any disclaimer, the term of this patent is extended or adjusted under 35 U.S.C. 154(b) by 0 days.

(21) Appl. No.: 12/746,218

(22) PCT Filed: Jul. 24, 2008

(86) PCT No.: PCT/KR2008/004322

§ 371 (c)(1),
(2), (4) Date: Jun. 4, 2010

(87) PCT Pub. No.: WO2009/078531

PCT Pub. Date: Jun. 25, 2009

(65) Prior Publication Data

US 2010/0254562 A1 Oct. 7, 2010

(30) Foreign Application Priority Data

Dec. 15, 2007 (KR) ..... 10-2007-0131824

(51) Int. Cl.
*H04R 25/00* (2006.01)

(52) U.S. Cl. ..... 381/371; 381/380; 381/328

(58) Field of Classification Search ..... 381/380, 381/328, 370–374, 381; 181/129, 130
See application file for complete search history.

(56) References Cited

U.S. PATENT DOCUMENTS

| | | | | |
|---|---|---|---|---|
| 6,856,690 | B1 * | 2/2005 | Skulley | 381/371 |
| 7,564,988 | B2 * | 7/2009 | Azima et al. | 381/326 |
| 2006/0140434 | A1 * | 6/2006 | Yang | 381/380 |

FOREIGN PATENT DOCUMENTS

| | | | |
|---|---|---|---|
| JP | 08-195994 | A | 7/1996 |
| JP | 2006-191518 | A | 7/2006 |
| KR | 10-2001-0049210 | A | 6/2001 |
| KR | 10-0345475 | B1 | 7/2002 |
| KR | 10-2003-0030711 | A | 4/2003 |
| KR | 20-0372762 | Y1 | 1/2005 |

OTHER PUBLICATIONS

International search report (PCT/KR2008/004322) dated Jan. 30, 2009.
Written Opinion of the International Search Authority (PCT/KR2008/004322) dated Jun. 15, 2010.
International Preliminary Report on Patentability (PCT/KR2008/004322) dated Apr. 2, 2010.
Korean Intellectual Property Office Action dated Mar. 20, 2009.

* cited by examiner

*Primary Examiner* — Curtis Kuntz
*Assistant Examiner* — Sunita Joshi
(74) *Attorney, Agent, or Firm* — Maxon IP LLC; Justin H. Kim

(57) ABSTRACT

A bowl-shaped cover (1) with a hole at the bottom replaces the cover with a sound hole of the conventional earphone, thus creating a constant space. The earphone sound vibrates the cover (1) by beating the inside of the cover (1) and then the vibration is transmitted to a rubber drumhead (vibrating membrane) (2) which is attached onto the cover (1). The rubber drumhead (vibrating membrane) (2) of the earphone works as a soft earmuff and makes wearing feel soft and comfortable. The present invention relates to the earphone that converts sound into vibration and also isolates sound.

6 Claims, 2 Drawing Sheets

[Fig. 1]
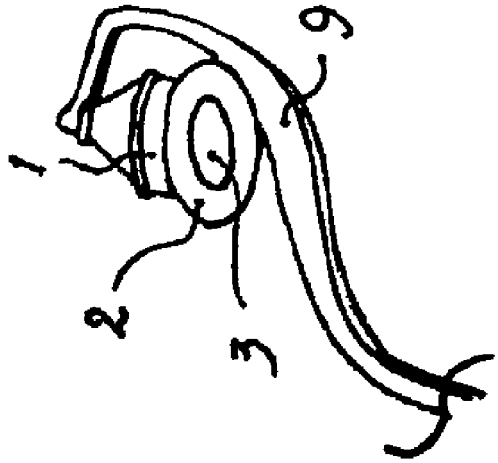
[Fig. 2]
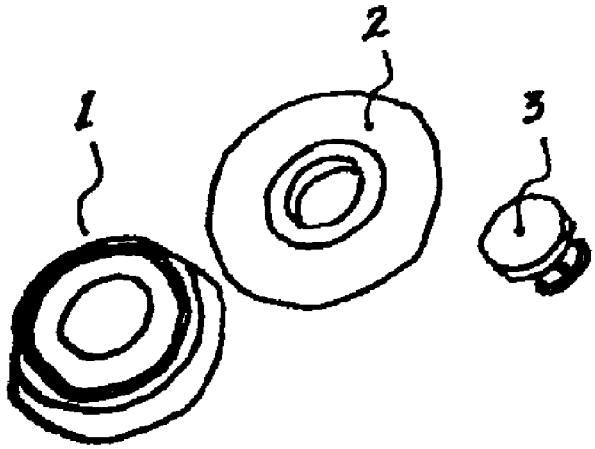
[Fig. 3]
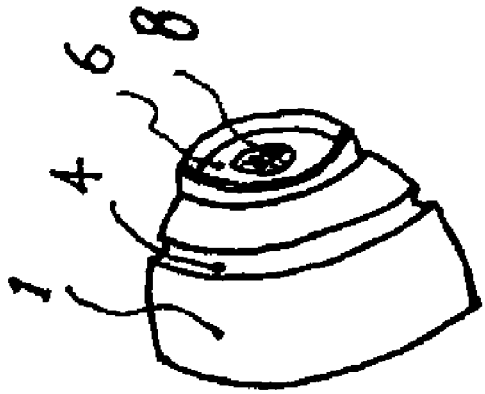

[Fig. 4]
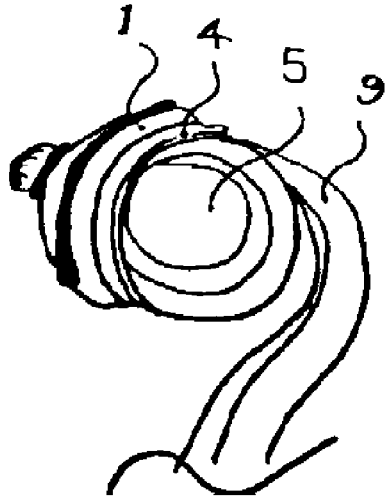
[Fig. 5]
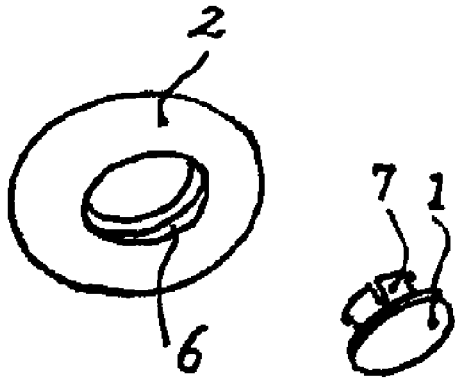
[Fig. 6]
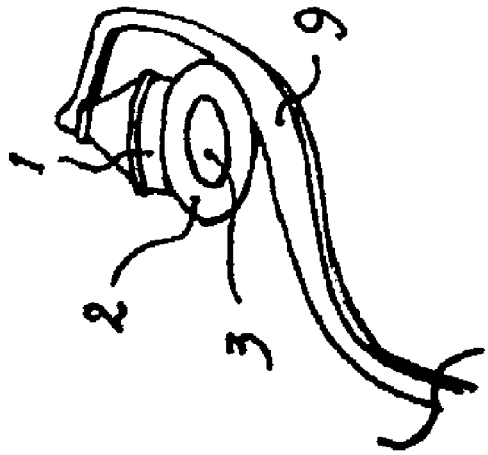

EARPHONE VIA DRUMHEAD

TECHNICAL FIELD

The present invention relates to a technology for an earphone that perceives sound through converting sound into vibration by removing the front cover of the conventional earphone and changing its structure.

BACKGROUND ART

The conventional earphones come in different types such as on-ear earphone, in-ear earphone, headphone that covers the entire external ear, etc. All these types have a common configuration that an electric signal is passed through a moving coil affixed to a diaphragm, causing the diaphragm to vibrate, thus producing sound. Extended use of the conventional earphone over time with loud sound could cause ear pain and, in severe cases, noise-induced hearing loss. Furthermore, as in-ear earphones or headphones that cover the entire external ear block out the external sounds, the speech and sound from a nearby person may not be recognized. For those with noise-induced hearing loss, increasing the sound volume to the eardrum is not much of help to improve the speech and sound recognition with the conventional earphones.

In the present invention, a bowl-shaped cover (1) with a hole at the bottom as shown in FIG. 3 replaces the conventional earphone cover, thus creating a constant space. The present invention relates to a technology that converts sound into vibration as the earphone sound vibrates the cover (1) by beating the inside of the cover (1) and then the vibration is transmitted to a rubber drumhead (vibrating membrane) (2) which is attached onto the cover (1).

The soft rubber drumhead (vibrating membrane) (2) makes a soft contact around the ear canal at the root of the ear, working as an earmuff. However, it is possible to recognize the external speech and sound from a nearby person and the earphone is also comfortable even with extended wearing over time. Additionally, it protects the eardrum and hearing ability as the earphone sound is isolated by the enclosed cover and thus does not vibrate the eardrum.

A fact has been discovered that sound can be perceived when the prominent cartilage near the ear canal at the root of the ear is stimulated with the vibration of rubber drumhead (vibrating membrane) (2).

Those with healthy ears can perceive, through the external ear canal and eardrum as well as through vibration, speech and sound including even a weak sound that is generated when the rubber drumhead (vibrating membrane) (2) vibrates. In this case, the sound can be heard more clearly because the sound is heard through two different channels at the same time.

Those who have hearing difficulties due to eardrum damage are able to perceive speech and sound by stimulating the prominent cartilage near the ear canal with vibration, not through the eardrum, thereby understanding language naturally.

DISCLOSURE OF INVENTION

Technical Problem

The front cover of earphone diaphragm is removed and a bowl-shaped cover (1) with a hole at the bottom takes its place as shown in FIG. 3. Then rubber drumhead (vibrating membrane) (2) is attached onto the cover (1) by means of a fixing pin (3) so that the vibration of the cover (1) is transmitted to the rubber drumhead (vibrating membrane) (2).

Technical Solution

A bowl-shaped cover (1) with a hole at the bottom replaces the conventional earphone cover for a diaphragm, thus creating a constant space.

A rubber drumhead (vibrating membrane) (2) is attached onto the cover (1) by means of a fixing pin (3) so that the vibration of the cover (1) is transmitted efficiently. At this time, the contact area on the other side of the rubber drumhead is made large so that it makes a close contact with the groove (4) around the edge of the cover (1), thus enhancing the efficiency of vibration transfer.

Moreover, the fixing pin (3) can be omitted by forming a projection at the center of the cover (1) onto which the rubber drumhead (2) is fit.

The feeling of wearing the earphone can be softer by properly cutting open a portion of the surface of the rubber drumhead (2).

The fixing frame (9) for both the right side and the left-side earphone is made of elastic material so that, when wearing the earphone, the rubber drumhead (vibrating membrane) (2) is in close contact with the prominent cartilage near the ear canal at the root of the ear, thus transmitting the vibration efficiently to the prominent cartilage.

Advantageous Effects

The rubber drumhead (vibrating membrane) (2) with its hollow ring shape is made of soft material and makes a soft contact around the ear canal at the root of the ear, working as an earmuff. However, the earphone is comfortable even with extended wearing over time, and external speech and sound from a nearby person is heard well.

Even those who cannot hear speech and sound through the eardrum can perceive speech and sound by stimulating the prominent cartilage near the ear canal at the root of the ear with the vibration of the rubber drumhead (vibrating membrane) (2). Therefore, it should be possible to come up with a new type of hearing aid that helps perceive speech and sound by stimulating with vibration the prominent cartilage near the ear canal at the root of the ear, not by vibrating the eardrum with sound like a conventional hearing aid.

Because the earphone sound is isolated by the cover (1), ears can be protected by preventing the eardrum and hearing ability from being damaged by a loud earphone sound.

Those with healthy ears can perceive, through the external ear canal and eardrum as well as through vibration, even a weak sound that is generated when the rubber drumhead (vibrating membrane) (2) vibrates. In this case, the sound can be heard more clearly because the sound is heard through two different channels at the same time.

In fact, according to an experiment for those with hearing-impaired people and poor understanding of language, they were able to understand language with this earphone to the same level as people with normal hearing.

BRIEF DESCRIPTION OF DRAWINGS

FIG. 1: a perspective view of the earphone equipped with a rubber drumhead (vibrating membrane) (2)

FIG. 2: an illustration of the cover (1), the rubber drumhead (vibrating membrane) (2), and the fixing pin (3) thereof FIG. 3: a perspective view of the cover (1)

FIG. 4: an appearance of the cover (1) attached in front of the diaphragm (5)

FIG. 5: an appearance of the rubber drumhead (vibrating membrane) (2) and the fixing pin (3) that are going to be attached onto the cover (1)

FIG. 6: a view of the final assembly of the earphone (1)—cover
(2)—rubber drumhead (vibrating membrane)
(3)—fixing pin
(4)—groove around the edge of the cover (1)
(5)—diaphragm
(6)—joint area of the fixing pin when assembled
(7)—hook of the fixing pin
(8)—connection area of the hook of the fixing pin when assembled
(9)—fixing frame for both the right-side and the left-side earphone

BEST MODE FOR CARRYING OUT THE INVENTION

A bowl-shaped cover (1) with a hole at the bottom as shown in FIG. 3 replaces the conventional earphone cover for a diaphragm, thus creating a constant space. The cover is made of relatively hard material, such as hard plastic. Its thickness should be determined properly with an experiment, as it has to do with vibration. However, it can be made of soft material like rubber or a combination of hard and soft material.

As shown in FIG. 5, the rubber drumhead (vibrating membrane) (2) has a hollow ring shape. The round hole at the diaphragm side should be bigger than the fixing pin (3) for rubber drumhead (vibrating membrane) (2), and the groove (4) on the cover (1) is cut out around the edge in a semi-circular shape in such a way that the contact area is made as large as possible. Also the rubber drumhead (vibrating membrane) (2) is rolled in a semi-circular shape in such a way that it makes a natural contact with the groove (4) around the edge of the cover (1).

However, the rubber drumhead (vibrating membrane) (2) can be built into the cover (1) as one body. At any way, its material should be of solid and the rubber drumhead (vibrating membrane) (2) is made soft for a comfortable wear.

In case the sound is found to be unnatural through the examining of the timbre of the sound that has been obtained by stimulating the prominent cartilage near the ear canal at the root of the ear with vibration of the rubber drumhead (vibrating membrane) (2) that is transmitted from the cover when the cover (1) vibrates as the earphone sound beats the inside of the enclosed cover (1), the timbre of the sound can be tuned by making a pin-hole at the groove (4) around the edge of the cover (1) or the center of the surface of the cover (1).

MODE FOR THE INVENTION

After removing the cover with a sound hole of a conventional earphone, a bowl-shaped cover (1) with a hole at the bottom as shown in FIG. 3 is placed in front of the diaphragm of the earphone as shown in FIG. 4. The rubber drumhead (vibrating membrane) (2) as shown in FIG. 5 is then fixed onto the front of the cover (1) by means of a fixing pin (3) before the final assembly as shown in FIG. 6.

INDUSTRIAL APPLICABILITY

Nowadays, thousands of different types of earphones and headphones are being produced and their performances are all different. All these earphones are of air conduction type where the sound is perceived by vibrating the eardrum with the sound that is generated by vibrating the diaphragm by magnetic action as electric current flows through a moving coil affixed to a diaphragm that is located within magnetic field of permanent magnet. It is also a well-known fact that loud sounds through the eardrum damage hearing ability. Therefore, hearing with reduced volume is the only safe way.

The present invention relates to a new type of earphone that perceives sound by stimulating the projected cartilage near the ear canal at the root of the ear with the vibration of the rubber drumhead (vibrating membrane) (2) that is transmitted from the earphone cover (1). As the cover isolates the sound, it is an obvious effect that eardrum and hearing ability can be Protected. Therefore, the number of people who would like to protect their own ears is going to increase everyday and the number of people who hearing-impaired people also increase everyday as people are living longer life. The demand for the type of fine quality hearing aid equipped with this earphone will be tremendous in the world market.

KEYWORDS

Rubber drumhead (vibrating membrane) (2), prominent cartilage, noise-induced hearing loss, fixing pin (3), cover (1)

The invention claimed is:

1. An earphone, comprising:

a diaphragm that vibrates in response to an electric signal and generates a sound;

a cover acoustically coupled with the diaphragm, the cover having an opening configured to receive a fixing pin, wherein the fixing pin covers the opening so that the sound is substantially contained within the cover and generates a vibration in the cover; and a vibrating membrane affixed to the cover by the fixing pin, wherein when the earphone is placed in a person's ear, the vibrating membrane transmits the vibration from the cover to stimulate a contact portion of near the person's ear canal whereby the person perceives the sound through the stimulation.

2. The earphone according to claim 1, wherein the vibrating membrane is made of rubber, and the contact portion is the prominent cartilage near the ear canal.

3. The earphone according to claim 2, further comprising an elastic fixing frame so that the vibrating membrane is in close contact with the prominent cartilage.

4. The earphone according to claim 3, the vibrating membrane is ring-shaped.

5. A hearing aid comprising an earphone according to any one of claims 1-4.

6. A method for transmitting a sound signal via the prominent cartilage near a person's ear canal, comprising:

introducing a sound into an earphone, said earphone comprises: a cover having one opening that receives the sound, wherein the sound is substantially contained within the cover and generates a vibration in the cover, and a rubber drumhead affixed to the cover; and placing the earphone in the person's ear so that the rubber drumhead is in contact with the prominent cartilage near the ear canal, whereby the vibration in the cover is transmitted through the rubber drumhead to stimulate the prominent cartilage so that the person perceives the sound through the stimulation.

* * * * *

UNITED STATES PATENT AND TRADEMARK OFFICE

CERTIFICATE OF CORRECTION

PATENT NO. : 8,213,663 B2
APPLICATION NO. : 12/746218
DATED : July 3, 2012
INVENTOR(S) : Youn Young Koo It is certified that error appears in the above-identified patent and that said Letters Patent is hereby corrected as shown below:

Fig. 5: replace "1" with -- 3 --. (See Attached Sheet)

Signed and Sealed this
Fifth Day of March, 2013

[Fig. 4]
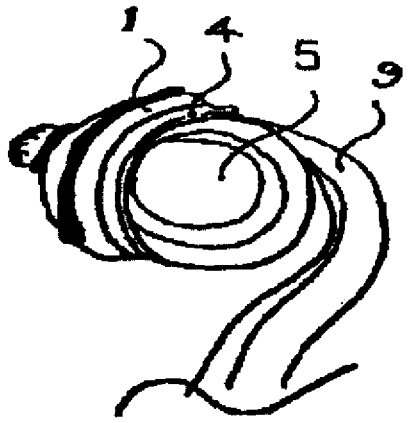
[Fig. 5]
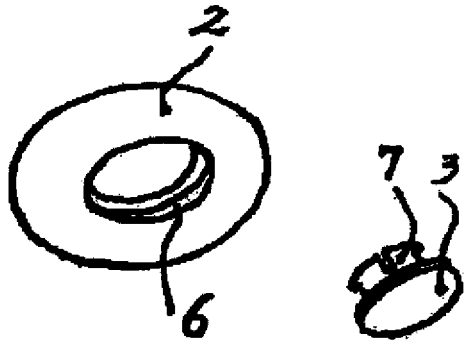
[Fig. 6]
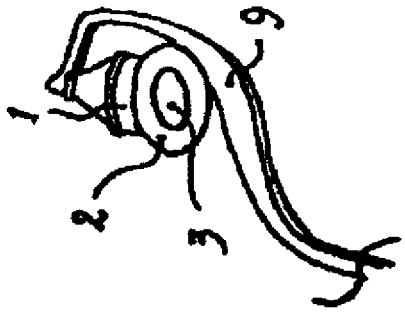

Teresa Stanek Rea
*Acting Director of the United States Patent and Trademark Office*